United States Patent [19]

Decker

[11] Patent Number: 4,656,744

[45] Date of Patent: Apr. 14, 1987

[54] SCRIBING TOOL FOR WALL PANELS AND THE LIKE

[76] Inventor: Henry P. Decker, 2233 S. Alton Way, Denver, Colo. 80231

[21] Appl. No.: 696,251

[22] Filed: Jan. 29, 1985

[51] Int. Cl.[4] ..... B43L 13/02

[52] U.S. Cl. ..... 33/41.5; 33/42

[58] Field of Search ..... 33/41, 42, 27 C

[56] References Cited

U.S. PATENT DOCUMENTS

| | | | |
|---|---|---|---|
| 1,309,930 | 7/1919 | Akin | 33/42 |
| 1,416,357 | 5/1922 | Knuusi | 33/41 E |
| 1,662,165 | 3/1928 | Punt . | |
| 1,993,132 | 3/1935 | Cathcard . | |
| 2,274,727 | 3/1942 | Neiss et al. | 33/42 |
| 2,287,601 | 6/1942 | Callaghan | 33/41 E |
| 2,557,699 | 6/1951 | Silver . | |
| 2,594,193 | 4/1952 | Mendes | 33/42 X |
| 2,968,098 | 1/1961 | Collin . | |
| 4,318,226 | 3/1982 | Engelhart | 33/41 E |
| 4,388,761 | 6/1983 | Henderson . | |

*Primary Examiner*—Harry N. Haroian

*Attorney, Agent, or Firm*—Wm. Griffith Edwards

[57] ABSTRACT

A device for marking wall panels or the like with irregular lines, which conform to irregular surfaces such as stone or brick walls, comprises a bar and a slide adjustable thereon to selected distances from the wall to be traced. The slide including a tube mounted on the slide at right angles thereto for receiving a pencil or stylus, the tube has a central hole adjacent the slide and a conical sharpened pencil will fit both holes and lock the pencil in position for tracing a line. A swingable handle is pivoted at the other end of the bar from the tracing point, and swings in a plane spaced from that of the bar sufficiently to allow the operator to grip the handle without interference with the bar. The user grips the handle and the pencil and holder, and, while keeping the bar horizontal holds the point against the irregular wall and moves it along the wall to trace the irregular line on a wall panel or the like. The wall panel may then be cut to the line which will fit the wall closely. A spirit level is provided on the bar to enable the operator to check the level position of the bar.

12 Claims, 9 Drawing Figures

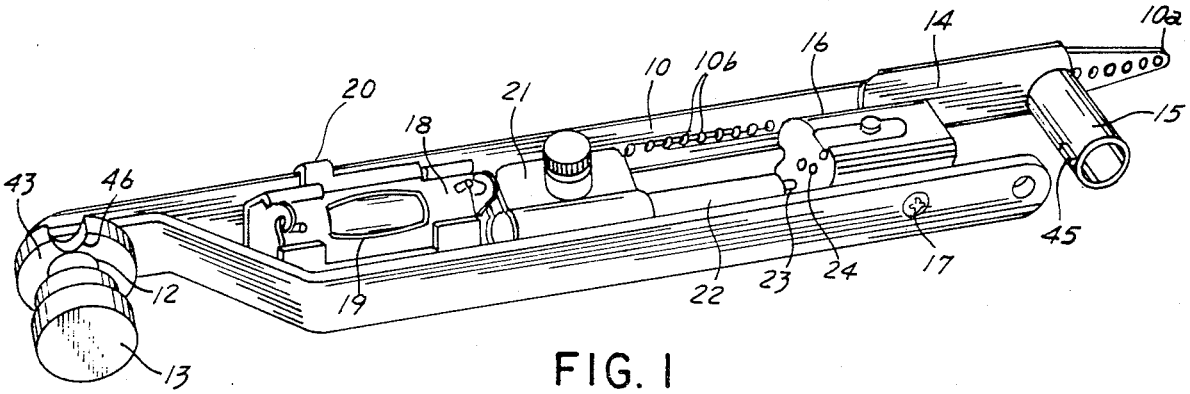
FIG. 1
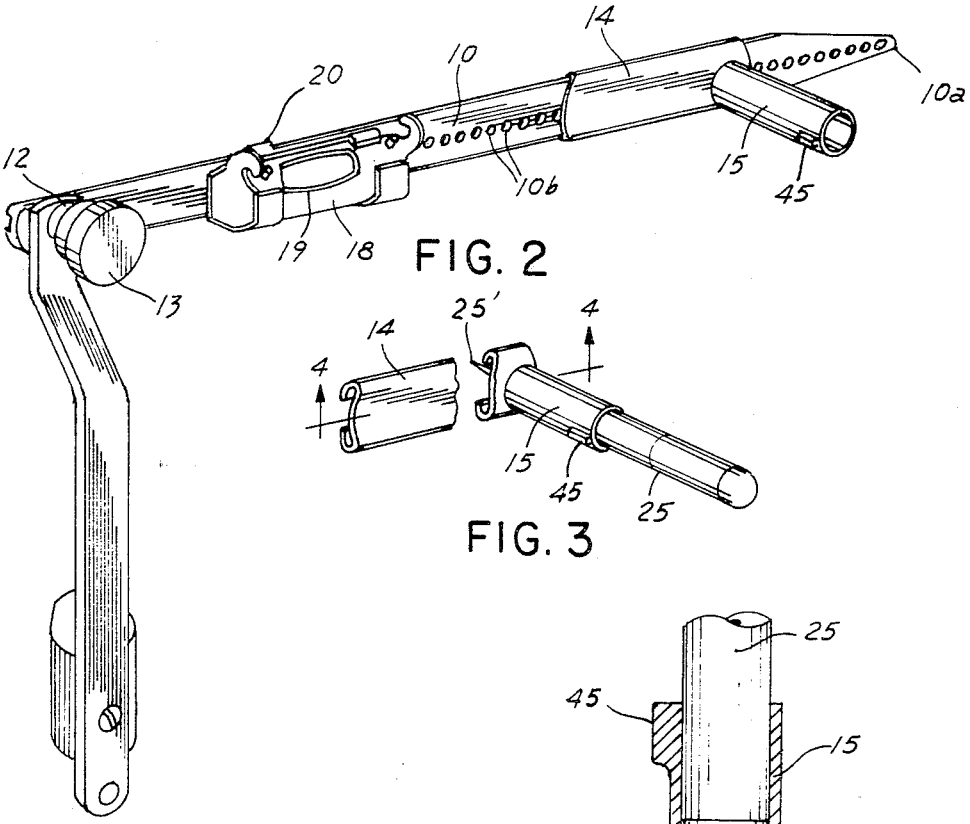
FIG. 2
FIG. 3
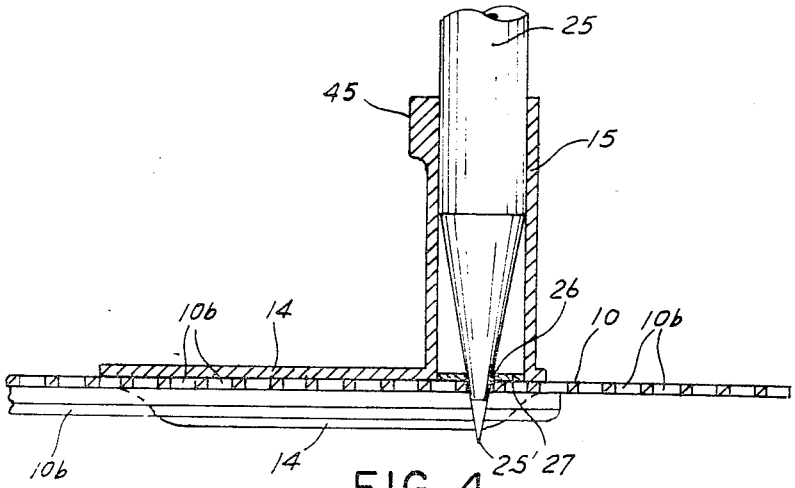
FIG. 4

SCRIBING TOOL FOR WALL PANELS AND THE LIKE

This invention relates to the fitting of wall panels and the like for engagement with stone, brick or other irregular wall surfaces, and particularly to an improved tool for marking a panel with an irregular line for guiding a saw to cut an edge line on the panel to closely fit the irregular wall surface.

BACKGROUND OF THE INVENTION

When wall panels are required to fit in edge engagement with an irregular surface such as a brick or stone wall it is desirable to mark a line on the panel which may be cut accurately to provide the same contour line for fitting closely along the irregular wall. Various scribing or marking devices have been provided or disclosed heretofore for this purpose. By way of example, one device used by carpenters is a compass or divider and U.S. Pat. No. 2,968,098 Collin discloses a device of this type which includes a spirit level for helping the user to maintain the same position of the device during the marking of a long line. Other devices include straight bars having rounded points for engaging the surface to be fitted and a stylus or point mounted on an adjustable slide for marking the line on a flat surface. U.S. Pat. No. 2,287,601 Callaghan discloses an example of this type of scriber.

It is an object of the present invention to provide an improved tool for marking irregular lines on wall panels or the like for cutting the edge of the panel to conform to an irregular wall surface.

It is a further object of this invention to provide an improved scriber or marker including an improved arrangement for effecting the accurate marking of irregular contact lines on wall panels and the like.

BRIEF SUMMARY OF THE INVENTION

The marking device of this invention comprises an elongated bar having a small rounded tracing point at one end and a handle pivoted near the other end and offset from the bar to leave a space between the handle and the surface to be marked. A slide on the bar carries a guide for a pencil or other marker. The bar is provided with a straight row of holes and the guide has a bottom hole through which a pencil may project and extend through any one of the holes in the row into position for marking a surface. This arrangement of the pencil and slide locks the pencil in position during marking. During the marking of a wall panel the operator holds the handle in one hand and the pencil in the other and moves the tool bodily over the surface to be marked while holding the tracing point against the irregular surface. The row of holes is provided so that the pencil point may be positioned at a distance from the point for marking the line on the panel or other surface corresponding to the deepest identation of the irregular surface. A sharpener is provided to shape the pencil point and provide the conical configuration to fit both the bottom hole of the guide and a hole in the bar for locking the pencil and slide in position on the bar. The sharpener is mounted near the free end of the handle so that the operator can use it without removing the tool from its position against the work. A spirit level is mounted on the tool so that the user can check the position of the tool during the marking operation.

BRIEF DESCRIPTION OF THE DRAWINGS

The features of novelty which characterize this invention are set forth in the appended claims; the invention itself, however, will be more fully understood from the following detailed description taken in connection with the accompanying drawings in which:

FIG. 1 is an isometric view of the tool of this invention when folded for storage or carrying;

FIG. 2 is an isometric view of the tool of FIG. 1 shown open and ready for use;

FIG. 3 is an isometric view of the marker slide partly broken away;

FIG. 4 is an enlarged vertical section view along the line 4—4 of FIG. 3 showing the marking pencil in position;

DETAILED DESCRIPTION

Figure 8:
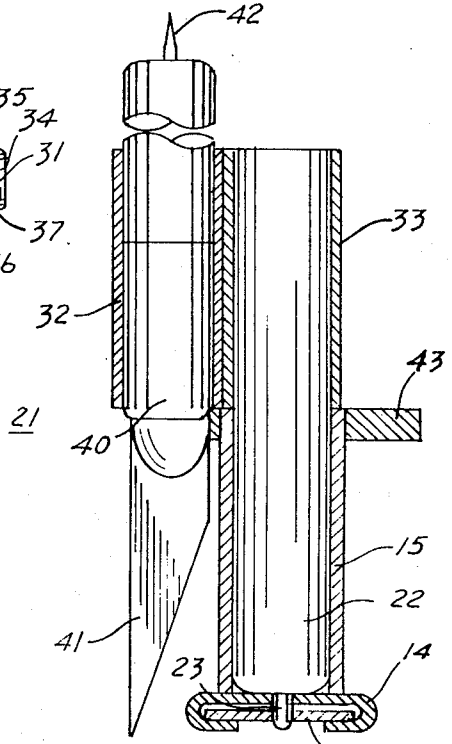
FIG. 8 is a sectional elevation view of the holder of FIG. 7, with a cutting knife in position.

The scribing tool shown in FIG. 1 comprises a bar 10 having a handle 11 pivotally secured to the bar near the left hand end thereof. The bar has a rounded point **10*a* at its outer end for engaging and following an irregular surface the line of which is to be scribed or drawn on a wall panel or the like. The bar 10 and handle 11 are held together by a thumbscrew 12 having a head 13 for turning the screw pivot to lock the bar and the handle 11 together. The thumbscrew 12 is threaded in the bar 10 for purposes of adjustment and for securing the handle at selected angles with respect to the bar. A member 14 is slidably mounted on the bar and is provided with a sleeve 15 extending normal thereto and rigidly secured to the right hand end thereof. The sleeve is arranged to receive a scriber and has been shown as cylindrical and of a size to receive a conventional lead pencil. The bar 10 has a straight row of equally spaced holes 10*b* extending along the center of the bar from a point close to the tip 10*a*. These holes allow the scriber to be positioned at a selected distance from the point. The enlarged view, FIG. 4, shows the pencil 25 in the sleeve 15 with its tapered portion positioned in a hole 26 in an end plate 27 at the bottom of the sleeve and with a smaller portion of the taper in one of the holes 10*b* in the bar 10**.

A pencil sharpener 16 is pivotally mounted on the handle near the free end thereof; the sharpener body is of generally triangular cross section and has three openings for the pencil which face the outer end of the handle. The sharpener is thus close at hand while the scribing tool is being used. The sharpener is secured to the handle by a pivot screw 17, and may be positioned at other angles about the pivot or may be removed from the handle.

A spirit level 18 is pivotally mounted on the bar 10 near the left hand end as illustrated. The bubble of the level is readily seen through a window 19 while the tool is in use. If the bar 10 is used in a vertical position, the level may be rotated 90°, a stop 20 engages the bar 10 as shown in the horizontal position; when the level is rotated ninety degrees counterclockwise to lie normal to the bar, the stop 20 engages the bar on the opposite side of the pivotal mounting of the level.

When the tool is not in use the handle is folded over the bar generally in the position illustrated in FIG. 1. The knob 13 may be loosened slightly and the member 14 moved back under the pencil sharpener and with the sleeve 15 under the end of the handle, then by tightening the knob 13 the handle end is pressed against the top of the sleeve and all elements of the tool are held together. Other elements such as a cutting knife assembly 21 may be secured between the bar 10 and the handle for storage. The knife assembly, to be described below, is provided with a cylinder 22 which fits in the sleeve 15 and has a metal pin 23 to fit the hole in the bottom of the sleeve and also a hole in the left end of the pencil sharpener and indicated at 24.

When the scribing tool is to be used, a pencil 25 is placed in the sleeve 15 as indicated in FIG. 3 and is seated in the hole 26 at the center of the end closure or plate 27 at the bottom of the sleeve, and also is seated in the one of the holes **10*b* in the bar 10. The point 25' of the pencil then extends beyond the member 14** for engagement with the panel or other surface to be marked.

Figure 5:
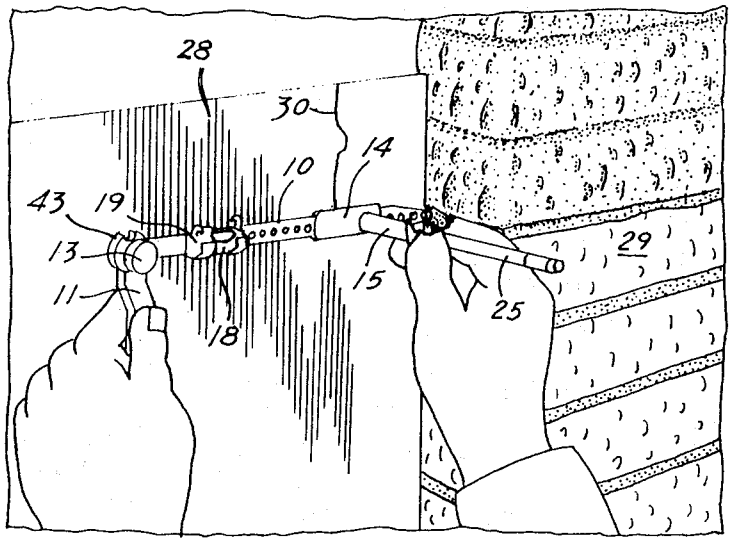
FIG. 5 is a perspective view of the tool when in use on a wall panel the thumb and forefinger being partly broken away to show the point of the tool.

FIG. 5 illustrates the manner in which the tool is used when marking a wall panel 28 with a line conforming to an irregular surface. The handle is held by the left hand and the pencil and sleeve 15 by the right hand. The bar 10 is held level with the point **10*a* in contact with the irregular wall indicated at 29, and the bar is then moved downwardly while the point 10*a* is kept in engagement with the wall 29, with the bar 10 level and with the pencil marking the line on the panel. The line drawn is indicated at 30, and is the line along which the panel 28 is to be cut so that its edge will fit closely against the wall 29 when the board or panel 28** is moved to the right against the wall.

The arrangement of the handle so that the bar 10 can be held against the panel 28 by one hand while the marking pencil is held in position by the other hand makes it easy to move the bar 10 downwardly along the panel 20 while holding the point **10*a* in engagement with the irregular surface of the wall 29. Observation of the level 18** further helps to maintain the desired position of the tool.

When the line to be drawn is substantially horizontal the bar 10 is held in vertical position and the level 18 is turned 90° so that it is at a right angle to the bar.

Figure 6:
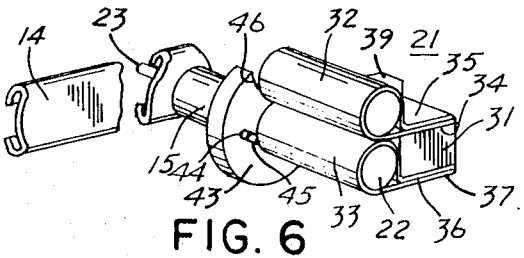
FIG. 6 is an isometric view of a holder for cutting knife.
Figure 7:
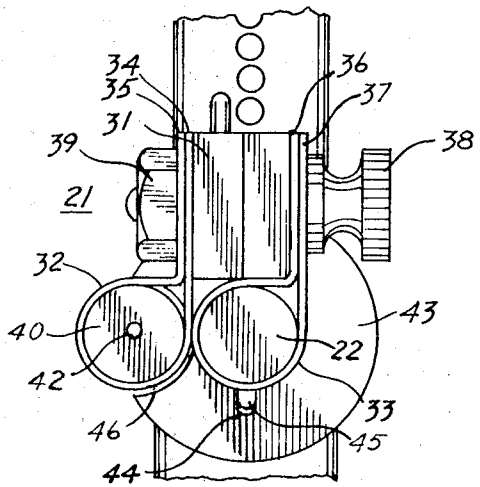
FIG. 7 is an enlarged plan view of the holder of FIG. 6.

Other scribing or cutting devices may be fitted in the sleeve 15, and the cutting knife assembly 21 is an example. This assembly, as shown in FIG. 6 and FIG. 7, includes a block 31 to which are secured two sleeves 32 and 33. The cylinder or plug 22, which is of the same diameter as a pencil and will fit closely in the sleeve 15 of the slide 14, is secured in the sleeve 33. The plug 22 has the pin 23 projecting from its end remote from the block 31, and the pin will pass through the openings 26 and **10*b* in the same manner as a pencil point to lock the slide 14 in position on the bar 10. The sleeve 32 is a split sleeve made with two laterally extending wings 34 and 35, and the sleeve 33 has similar wings 36 and 37. The inner wings 34 and 36 of the sleeves 32 and 33 are secured to opposite sides of the block 31 by suitable means such as by soldering or brazing, and the outer wings are free to flex outwardly, and are clamped against the inner wings by a thumb screw 38 and nut 39 so that they clamp the cylinder 22 and a cylindrical knife holder 40 firmly in position. The knife holder is arranged to clamp a pointed knife 41 in position and has a sharp point or scriber 42** at its opposite end.

When the knife holder 21 is to be used, a disc 43 shown in FIG. 1 is removed from its carrying position shown in FIG. 1 and is fitted tightly at the top of the sleeve 15, with a notch 44 engaging a projection 45 at the top of the holder as shown in FIG. 7.

The disc 43 is seated at the top of the cylinder 15 and is held in position so that a circular notch 46 which fits closely about the circumference of the cylindrical knife holder 40 secures the holder so that the knife 41 is held at the side of the bar 10 and may extend downwardly into cutting engagement with a sheet of paper, cardboard or other sheet material to be cut. A circle thus may be cut by rotating the bar 10 about a pivot provided at its opposite end.

Figure 9:
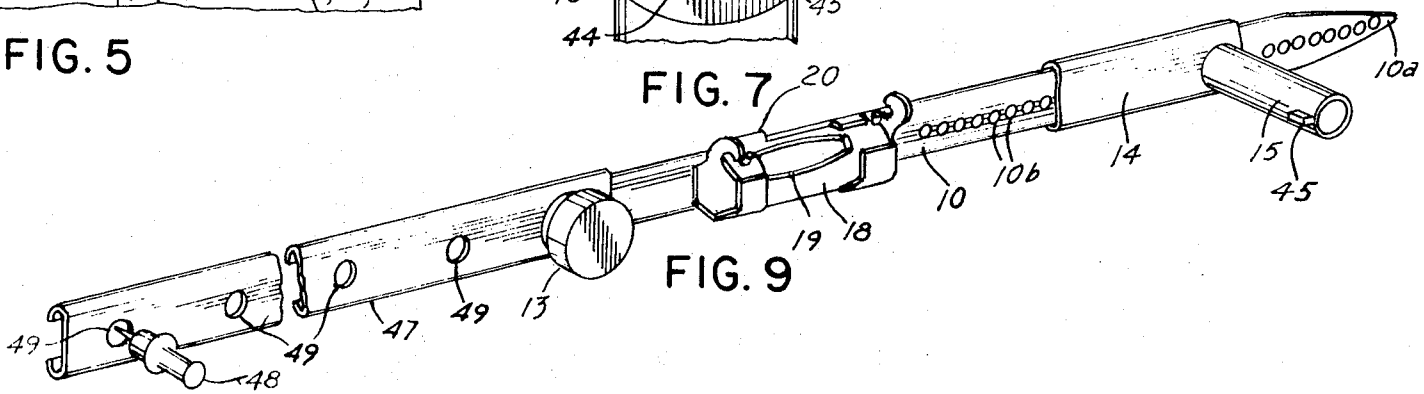
FIG. 9 is an isometric view of the bar and slide of the tool of FIG. 1 fitted with an extension for the drawing of long-radius circular lines.

As shown in FIG. 9 an extension bar 47 may be provided when it is desired to draw or cut circles of greater diameters than with the bar 10 alone. This bar is constructed of slightly larger cross section than the bar 10 and telescopes with the bar 10 and the bars are held together by the thumb screw 13. A push pin 48 may be inserted through a selected one of the several holes 49 in the bar 47 and thus be secured pivotally to a drafting board or other plane surface. The member 14 is then positioned on the bar 10 and a pencil or the knife assembly 21 may be used to mark or cut a circle.

The scribing device as disclosed here makes it possible to draw highly accurate irregular lines for fitting the edges of wall panels to stone walls and other walls such as slumped brick walls. This accuracy can be attained at relatively high working speed and it is easy to use the device in a wide range of locations and conditions.

While the invention has been illustrated and described in connection with a specific embodiment, various modifications and other applications will occur to those skilled in the art, and it is not desired that the invention be limited to the specific construction disclosed, and it is intended, by the appended claims, to cover all modifications within the true spirit and scope of the invention.

I claim:

1. A tool for marking irregular lines on wall panels, sheets and the like to follow the contour of brick, stone or other irregular wall features, which comprises:

an elongated relatively flat member having a row of spaced holes extending longitudinally thereof and having a rounded point at one end for engaging an irregular wall surface, a second member slidably mounted on said elongated member and having an elongated guide for a marking device secured thereto and extending normal to and away from said row of holes, said guide having an end closure portion positioned adjacent said elongated member and having a central hole therein located for alignment with any selected one of the holes in said row, whereby a marking device when positioned in said guide and extending through said central hole and a selected hole of the row of holes and, when engaging the perimeters of both holes, locks said second member in its marking position.

2. A tool for marking irregular lines as set forth in claim 1 including a handle attached to said elongated member remote from said one end and having its gripping portion offset from said elongated member whereby said elongated member may be held in face engagement with a wall panel or the like which is to be marked, the gripping portion of the handle being held in one hand of the operator and the guide in the other hand while said rounded point is moved along the irregular surface.

3. A tool for marking irregular lines on wall panels, sheets and the like to follow the contour of brick, stone or other irregular wall features, which comprises, an elongated relatively flat member having a row of spaced holes extending longitudinally thereof and having a rounded point at one end for engaging an irregular wall surface, a second member slidably mounted on said elongated member and having an elongated guide for a marking device secured thereto and extending normal to and away from said row of holes, said guide having an end closure portion positioned adjacent said elongated member and having a central hole therein located for alignment with any selected one of the holes in said row, whereby a marking device when positioned in said guide and extending through said central hole and a selected hole of the row of holes and, when engaging the perimeters of both holes, locks said second member in its marking position, wherein said spaced holes are of the same size and in straight alignment and said spaced holes and said hole in said guide are of circular configuration, the hole in said guide being of larger diameter than said spaced holes, whereby a marker having a predetermined conical configuration will fit in said hole in said guide and in one of the said spaced holes in firm circular engagement with both said elongated member and said guide and may be held locked in such position during the marking of a line, with the point of the marker extending beyond the elongated member into engagement with the surface to be marked.

4. A tool for marking irregular lines as set forth in claim 3 wherein the marker is a lead pencil and said tool includes a pencil sharpener mounted thereon and having a cutting blade for sharpening a pencil to provide said predetermined conical configuration.

5. A tool for marking irregular lines as set forth in claim 1 or claim 2 including a spirit level rotatably and adjustably mounted on said elongated member for facilitating the holding of said elongated member in selected attitudes during marking.

6. A tool for marking irregular lines as set forth in claim 2 wherein the marker is a lead pencil and said tool includes a pencil sharpener mounted thereon and having a cutting blade for sharpening a pencil to provide said predetermined conical configuration, and further wherein said handle is pivotally mounted on said elongated member and is foldable into a position in overlapping alignment with said elongated member, said sharpener being secured to said handle on its side toward said elongated member and in the folded position of said handle lying between said elongated member and said handle.

7. A tool for marking irregular lines as set forth in claim 6 including a spirit level rotatably and adjustably mounted on said elongated member near the pivotal mounting of said handle for facilitating the holding of said elongated member in selected attitudes during marking, said level lying between the offset portion of said handle and said elongated member when said handle is in the folded position.

8. A tool for marking irregular lines on wall panels and sheets and the like to follow the contour of brick, stone or other irregular wall features, which comprises:

an elongated relatively flat member having a row of spaced holes extending longitudinally thereof and having a rounded point at one end for engaging an irregular wall surface, a second member slidably mounted on said elongated member and having a guide for a pencil or similar elongated marking device secured thereto and extending normal to the face of said member and away from said row of holes, said guide being constructed and arranged to hold the point of a marking device in alignment with any selected one of the holes in said row, whereby a marking device when positioned in said guide and extending through the selected hole of the row of holes and engaging the perimeter thereof holds said second member in its marking position, an elongated handle attached to said tool remote from said one end thereof and arranged to extend laterally therefrom, said guide with a pencil or the like therein constituting a second handle, whereby the tool may be manipulated effectively while holding the elongated handle in one hand and the guide and marking device in the other hand for accurately following an irregular surface with said rounded point to mark a line having the configuration of the surface.

9. A tool for marking irregular lines as set forth in claim 8, wherein said elongated handle is pivotally secured to said flat member, and including means for securing said handle at selected angular positions with respect to said flat members.

10. A tool for marking irregular lines as set forth in claim 9 including a spirit level adjustably mounted on said elongated member near the pivotal mounting of said handle for facilitating the holding of said elongated member in selected attitudes during marking.

11. A tool for marking irregular lines on wall panels and sheets and the like to follow the contour of brick, stone or other irregular wall features, which comprises:

an elongated relatively flat member having a row of spaced holes extending longitudinally thereof and having a rounded point at one end for engaging an irregular wall surface, a second member slidably mounted on said elongated member and having a guide for a pencil or similar elongated marking device secured thereto and extending normal to and away from said row of holes, said guide being constructed and arranged to hold the point of a marking device in alignment with any selected one of the holes in said row, whereby a marking device when positioned in said guide and extending through the selected hole of the row of holes and engaging the perimeter thereof holds said second member in its marking position, an elongated handle attached to said tool remote from said one end thereof and arranged to extend laterally therefrom, said guide with a pencil or the like therein constituting a second handle, whereby the tool may be manipulated effectively while holding the elongated handle in one hand and the guide and marking device in the other hand for accurately following an irregular surface with said rounded point to mark a line having the configuration of the surface, said tool further including a cutting blade assembly for mounting in said guide interchangeably with said marking device, said assembly including a cylindrical member for fitting in said guide and having an end projection to fit in said selected one of said holes, and a knife holder mounted on said cylindrical member for holding the knife in a position extending into a cutting position laterally of said flat member and means for preventing rotation of said knife holder about said guide.

12. A tool for marking irregular lines as set forth in claim 3 including a handle attached to said elongated member remote from said one end and having its gripping portion offset from said elongated member whereby said elongated member may be held in face engagement with a wall panel or the like which is to be marked, the gripping portion of the handle being held in one hand of the operator and the guide in the other hand while said rounded point is moved along the irregular surface.

* * * * *